US007470496B2

(12) United States Patent
Koyama et al.

(10) Patent No.: US 7,470,496 B2
(45) **Date of Patent: *Dec. 30, 2008**

(54) ELECTROSTATIC IMAGE DEVELOPING TONER

(75) Inventors: Mikio Koyama, Kunitachi (JP); Kenji Hayashi, Hachioji (JP); Kazuya Isobe, Hachioji (JP); Yasuharu Saita, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 371 days.

This patent is subject to a terminal disclaimer.

(21) Appl. No.: 11/341,566

(22) Filed: Jan. 26, 2006

(65) Prior Publication Data

US 2006/0172213 A1 Aug. 3, 2006

(30) Foreign Application Priority Data

Feb. 2, 2005 (JP) ..... 2005-026189

(51) Int. Cl.
*G03G 9/08* (2006.01)

(52) U.S. Cl. ..... 430/108.4; 430/110.1; 430/124.1; 430/124.3

(58) Field of Classification Search ..... 430/108.4, 430/110.1, 124.1, 124.3
See application file for complete search history.

(56) References Cited

U.S. PATENT DOCUMENTS

| | | | | |
|---|---|---|---|---|
| 4,476,212 | A | 10/1984 | Kakimi | |
| 2003/0036013 | A1 | 2/2003 | Yamazaki | |
| 2003/0175043 | A1 * | 9/2003 | Handa et al. | 399/111 |
| 2004/0197692 | A1 | 10/2004 | Yamane | |
| 2006/0073401 | A1 * | 4/2006 | Koyama et al. | 430/108.4 |

FOREIGN PATENT DOCUMENTS

| | | |
|---|---|---|
| JP | 2000-214629 | 8/2000 |
| JP | 2002-287405 | 10/2002 |
| JP | 2003-091101 | 3/2003 |

* cited by examiner

*Primary Examiner*—Mark F Huff
*Assistant Examiner*—Rachel L Burney
(74) *Attorney, Agent, or Firm*—Lucas & Mercanti, LLP

(57) ABSTRACT

An electrostatic image developing toner comprising a binder resin and a colorant, wherein the toner comprises a compound represented by the following Formula (1):

Formula (1)

wherein, $R_1$, $R_2$, $R_3$ and $R_4$ each independently represent an alkyl group having 10 to 30 carbon atoms and the alkyl group may have a substituent.

12 Claims, 4 Drawing Sheets

ELECTROSTATIC IMAGE DEVELOPING TONER

FIELD OF THE INVENTION

The present invention relates to an electrostatic image developing toner, more specifically, relates to an electrostatic image developing toner containing an ester compound having a specified structure.

BACKGROUND OF THE INVENTION

Recently in the field of the image forming technology based on electrophotography such as copiers and printers, required has been a technology of a level which enables an accurate reproduction of a microdot image of 1200 dpi (in the present invention, "dpi" indicates the number of dots per 2.54 cm) in accordance with the development of the digital technology.

In order to faithfully reproduce the microdot image, miniaturization of the diameter of a toner particle has been studied, and attracted attention has been a chemical toner represented by a polymerization toner to which various types of controls can be applied in the manufacturing process, and, as a result, toner with a small diameter for faithfully reproducing the microdot image has been obtained (for example, see Patent Document 1).

On the other hand, as a method for fixing a toner image transferred on an image forming substance (also referred to as a transfer material) such as paper, a fixing method based on contact fixing, for example, a thermal roll fixing method and a thermal belt fixing method, is widely used. However, the contact fixing method tends to cause an offset problem in which melted toner adheres onto a heat member and the adhered toner is transferred to another image forming substance.

As the method to prevent the offset problem, for example, there has been a method to add a releasing property to the heat member by coating silicon oil on a surface of the heat member of a fixing device. However, the transfer material (image forming substance) coated with silicon oil becomes unrewritable with a writing tool such as a ball-point pen, and the transfer material may be contaminated by a volatile component contained in the silicon oil, both of which are not favorable for a business tool.

To cope with the above problem, development of an oil-less toner in which a releasing property is added to the toner particle itself has been carried out, and appeared has been a technology to add a fixing improver in the toner particle to provide the toner with a releasing property. To provide a releasing property, for example, an oil-less chemical toner containing a compound such as an ester compound of higher fatty acid having a long chain hydrocarbon group has been developed (for example, see Patent Documents 2, 3). The appearance of the toner containing the ester compound as the release agent has greatly contributed to the development of the oil-less image formation technology.

Recently, for the image formation technology based on the electrophotographic method, there has been a demand to reduce the electric consumption of printers or copiers in order to reduce the influence to the environment in association with the image formation and the business costs in the office. As one of the measures to achieve the above demand, a technology to lower the fixing temperature of such electrophotographic image compared to the current fixing temperature has been attracted attention. Further, because of the characteristic that the required number of sheets can be printed at required time, an image forming apparatus based on electrophotography has been extensively used in the field of shortrun printing.

However, when fixing was carried out at a lower temperature using the toner containing the above ester compound, the formed toner image was found to have a tendency to easily peel from the transfer material. Further, when a large amount of printing was continuously carried out, for example, a several hundred-thousand-sheets of printing was repeated, the charge rising capability of the toner showed a tendency to degrade, accordingly, durability of the toner has been desired, by which the charge rising capability did not vary even when a large amount of image formation was repeated. As described above, there has been a demand to provide a property, which meets the new movements or the needs of the market, to an oil-less toner.

Patent Document 1: Japanese Patent Publication Open to Public Inspection (hereafter referred to as JP-A) No. 2000-214629 (see Paragraph 0061 and other paragraphs)

Patent Document 2: JP-A No. 2002-287405 (see Paragraph 0051 and other paragraphs)

Patent Document 3: JP-A No. 2003-91101 (see Paragraph 0208 and other paragraphs)

SUMMARY OF THE INVENTION

An object of the present invention is to provide an electrostatic image developing toner which enables a wide range of fixable temperature in which sufficient adhesion of the toner image to the transfer material is attained where the toner image hardly peels from the transfer material and offset to another transfer material is avoided, even when the toner image is fixed at a surface temperature of the transfer material as low as 100° C.

Another object of the present invention is to provide an electrostatic image developing toner exhibiting an excellent durability which enables to maintain a stable charge rising capacity of the tone even after a large amount of copies, for example, several hundred-thousand-sheets of copies, are carried out.

One of the aspects of the present invention is an electrostatic image developing toner comprising a binder resin and a colorant, wherein the toner comprises a compound represented by the following Formula (1):

Formula (1)

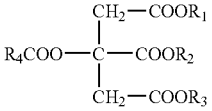

wherein, $R_1$, $R_2$, $R_3$ and $R_4$ each independently represent an alkyl group having 10 to 30 carbon atoms and the alkyl group may have a substituent.

DESCRIPTION OF THE PREFERRED EMBODIMENTS

Figure 1:
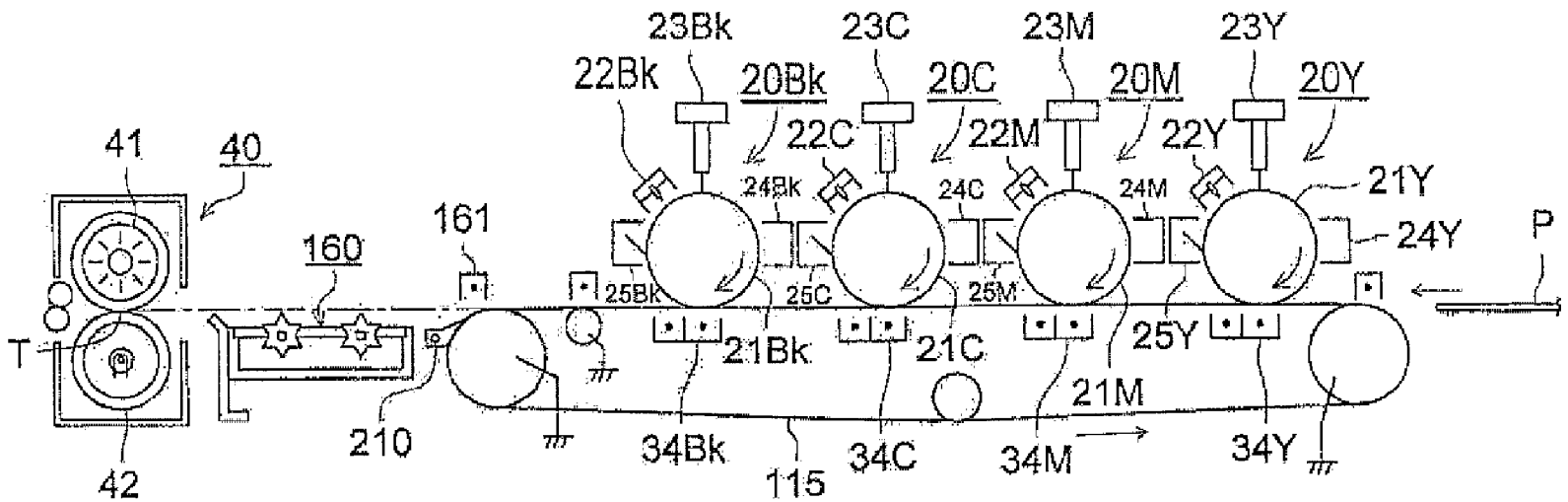
FIG. 1 is a cross-sectional configuration view showing an example of an image forming apparatus used in the present invention.

An electrostatic image developing toner containing a binder resin and a colorant, wherein the electrostatic image developing toner further contains a compound represented by Formula (1):

Formula (1)

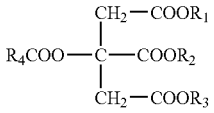

wherein $R_1$, $R_2$, $R_3$ and $R_4$ each independently represent an alkyl group having 10 to 30 carbon atoms and the alkyl group may have a substituent.

The electrostatic image developing toner of the present invention containing Formula (1) enables to provide an electrostatic image developing toner exhibiting an excellent adhesion of the toner image to the transfer material where the toner image hardly peels from the transfer material even when the toner image is fixed at a surface temperature of the transfer material as low as 100° C.

The present invention also enabled to provide of an electrostatic image developing toner exhibiting an excellent durability of the electrostatic image developing toner, by which high density images without fogging are obtained because the charge rising capacity of the toner is stable, even after a large amount of copies, for example, several hundred-thousand-sheets of copies, are carried out.

The present invention relates to a toner for developing an electrostatic image (hereafter, merely referred to as a toner) containing a compound expressed by the Formula (1).

The toner containing the ester compound represented by the Formula (1) was found to exhibit a strongly fixing property in which the toner image hardly peel from the transfer material even when the toner image is fixed at a surface temperature of the transfer material as low as 100° C.

This ester compound is formed by reacting a polycarboxylic acid having a relatively smaller number of carbon atoms and aliphatic alcohols each having a longer chain.

By using this structure as defined in Formula (1), while obtaining a releasing effect due to the existence of long chains, the fixing property of the toner image to the image forming substance is improved.

The reason why the fixing property is improved is not fully clear, however, it seems to be because, by having structure of Formula (1), the molecules become easier to array in a regular manner, resulting in forming a regular orientation of the ester groups to the cellulose molecules of the transfer material.

As a result, the adhesion property between the transfer material and the toner is improved. Further, the four long chain aliphatic groups existing within short distances would also have contributed to improve the releasing property.

It is also deduced that, since the compound represented by Formula (1) has a structure which is easy to be oriented, the compound is easy to be dispersed in the toner particle while keeping some extent of affinity. As a result, minute domain structure is formed in the toner particle and favorable dispersibility appears, resulting in improving the releasing property.

Further, charge rising capacity of the toner of the present invention was found to be stable, even after a large amount of copies, for example, several hundred-thousand-sheets of copies, were carried out. This is deduced to be because, the ester compound represented by Formula (1) has a structure in which the groups having strong affinity to water (ester groups) exist in the center part of the molecule. Namely, since the ester groups exist in the center part of the molecule near the quaternary carbon atom, in a process to form particles in an aqueous medium, the ester compound is supposed to take a structure in which the quaternary carbon is oriented toward the water. As a result, on the surface of the toner, the ester compounds exist with orienting the ester groups outside of the toner particle. Thus, toner particles having polar groups oriented outside of the toner are formed. The charge rising capability is improved due to the effect of the polar groups existing on the surface of the toner particles.

The present invention will be described in detail below.

Herein, the compound represented by Formula (1) contained in the toner is also referred to as an ester compound having a specified structure.

Toner of the present invention contains at least a binder resin and a colorant, and further contains the ester compound having the specified structure.

The ester compound having the specified structure contains ester groups represented by Formula (1) and the plurality of ester groups exist in the center part of the molecule.

Formula (1)

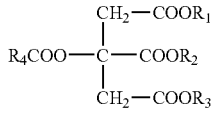

(In Formula (1), $R_1$, $R_2$, $R_3$ and $R_4$ each independently represent an alkyl group having 10 to 30 carbon atoms, the alkyl group may have a substituent, and $R_1$, $R_2$, $R_3$ and $R_4$ may be the same or may be different.)

The alkyl group represented by any one of $R_1$ to $R_4$ preferably does not have a substituent, however, as the substituent, a sulfonic acid group, a nitro group, an amino group and a hydroxyl group may be listed.

As specific examples of the ester compound having the specified structure, the following compounds represented by Formulas (1) to (7) are listed.

(1)

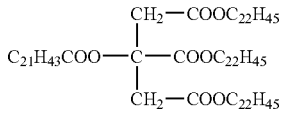

(2)

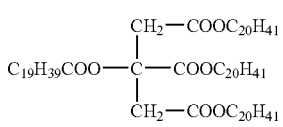

(3)

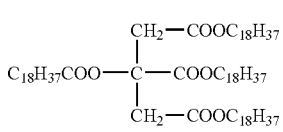

-continued (4)

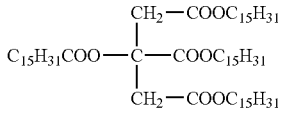

(5)

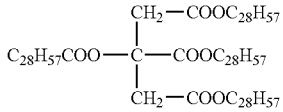

(6)

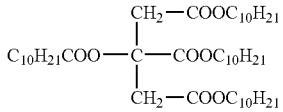

(7)

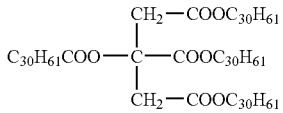

The preparation method of the ester compound having the specified structure used in the present invention is not specifically limited, and may be prepared, for example, via a dehydrating condensation reaction of polycarboxylic acid and long chain aliphatic alcohols having 10 to 30 carbon atoms.

The content of the ester compound having the specified structure of the present invention is preferably 1-15% by weight and more preferably 3-12% by weight based on the total weight of the toner.

The toner of the present invention may contain a plurality of compounds represented by Formula (1).

By controlling the content of the ester compound having the specified structure in the above described range, while exhibiting an excellent releasing property and an excellent electrostatic chargeability, the toner can exhibit a moderate adhesion property to a transfer material, and a stable fixing property can be obtained.

Next, the method of manufacturing the toner of the present invention will be described below.

The toner of the present invention is preferably obtained by at least polymerizing a polymerizable monomer in an aqueous medium. This manufacturing method includes: (i) preparing resin microparticles by polymerizing polymerizable monomer by means of suspension polymerization, or of emulsion polymerization or miniemulsion polymerization in an aqueous medium added with an emulsion of required additive, (ii) adding microparticles of a resin which works as a chargeability control agent, if necessary, and (iii) flocculating or fusing the formed particles by adding a flocculant such as an organic solvent or a salt.

(Suspension Polymerization Method)

An example of the method of manufacturing the toner of the present invention is as follows: a chargeability control resin is also added to the polymerizable monomer in which various types of component materials such as a colorant or a release agent according to the necessity and a polymerization initiator are added, and then the various types of component materials are dissolved or dispersed in the polymerizable monomer with a machine such as a homogenizer, a sand mill, a sand grinder, or an ultrasonic homogenizer. The polymerizable monomer with the various types of component materials dissolved or dispersed therein is dispersed in an aqueous medium containing a dispersion stabilizer into oil droplets of a desired size as a toner using a machine such as a homomixer or a homogenizer. Subsequently, the system is heated to carry out polymerization. After the reaction is completed, the dispersion stabilizer is removed from the resulting system, and then filtered, rinsed, and dried to prepare the toner of the present invention. The "aqueous medium" in the present invention represents that the water content in the medium is 50% by weight or more.

(Emulsion Polymerization Method)

Further, another method of manufacturing the toner of the present invention may include a method of preparing the toner by subjecting resin particles to salting-out/fusion-bonding in the aqueous medium. Listed as this method, although not specifically limited, may be methods disclosed in, for example, JP-A Nos. 5-265252, 6-329947, 9-15904. Namely, the toner of the present invention may be formed by the method in which a plurality of dispersion particles of the component materials such as resin particles and a colorant, or particles composed of a resin and a colorant and the like are subjected to salting-out, flocculation and fusion-bonding, specifically, after the particles are dispersed using these emulsifying agents in water, the resulting dispersion is added with a flocculating agent of the critical flocculation density or more to be subjected to salting-out, at the same time heat fusion-bonding at a temperature higher than the glass transition point of the formed polymer itself to form fused particles while gradually growing the particle diameter, and the diameter growing is stopped at the time when the intended particle diameter is acquired by adding a large amount of water, wherein the particles further being heated and stirred to control the shape of the particle surface to be flat and smooth, and then heated and dried in the state of containing water and fluidity. Incidentally, together with the flocculating agent, a solvent which is infinitely dissolvable to water such as alcohol may be added herein.

In the method of manufacturing the toner of the present invention, the preferably used method is that the ester compound having the specified structure is dissolved or dispersed in the polymerizable monomer followed by mechanically dispersing the monomer in an aqueous medium to be subjected to miniemulsion polymerizing and subsequently the formed composite resin particles and colorant particles are subjected to salting-out/fusion-bonding. When the ester compound having the specified structure is dissolved in the polymerizable monomer, the ester compound having the specified structure may be merely dissolved or may be dissolved after melting.

Further, in the method of manufacturing of the toner of the present invention, preferably employed is the process of subjecting the composite resin particles obtained by a multistage polymerization method and the colorant particles to salting-out/fusion-bonding.

Next, a preferable example of the method of manufacturing the toner (the emulsion aggregation method) will be described in detail.

This manufacturing method may include the following processes: (1) a dissolution/dispersion process to dissolve or disperse the ester compound having the specified structure in a radical polymerizable monomer; (2) a polymerization process to prepare a dispersion of resin particles; (3) a fusion-bonding process to fuse the resin particles and colorant particles in an aqueous medium to obtain colored particles (association particles); (4) a cooling process to cool down the dispersion of the toner particles; (5) a cleaning process to solid-liquid separate the toner particles from the cooled dispersion of the toner particles and to remove the surfactant from the toner particles; (6) a dry process to dry the cleaned toner particles; and, if necessity, (7) a process to add an external additive to the dried toner particles.

Each of the above processes will now be described below.

[Dissolution/Dispersion Process]

This process is a process to dissolve or disperse the ester compound having the specified structure in the radical polymerizable monomer to prepare a radical polymerizable monomer solution containing the ester compound having the specified structure.

[Polymerization Process]

In a preferred example of the polymerization process, liquid droplets of the radical polymerizable monomer solution containing the ester compound having the specified structure are formed by applying mechanical energy in an aqueous medium in which added is a surfactant of not more than the critical micelle concentration (CMC), and the polymerization is carried out in each liquid droplets with the radicals from the water-soluble radical polymerization initiator in the aqueous medium. Incidentally, an oil soluble polymerization initiator may be contained in the liquid droplets. In such a polymerization process, a treatment of forcibly emulsifying (forming liquid droplets) by applying mechanical energy is required. The means of applying the mechanical energy may include the means of applying the strong agitation or ultrasonic vibration energy such as a homo-mixer, ultrasonic waves, and Manton-Gaulin.

With the polymerization process, resin particles containing the ester compound having the specified structure and binder resin can be obtained. The resin particles may be colored particles or uncolored particles. The colored resin particles are obtained by subjecting the monomer composition containing a colorant to the polymerization treatment. When the uncolored resin particles are used, a dispersion of the colorant particles is added to the dispersion of the resin particles in the fusion-bonding process described below, wherein the resin particles and the colorant particles are fusion-bonded to form the toner particles.

[Fusion-bonding Process]

As the method of fusion-bonding in the fusion-bonding process, the salting-out/fusion-bonding method using the resin particles (colored or uncolored resin particles) obtained from the polymerization process is preferred. Further, in the fusion-bonding process, in addition to the resin particles and colorant particles, release agent particles and particles of an internal additive such as a charge control agent can be fusion bonded.

In the fusion-bonding process, the "aqueous medium" is referred to as that mainly of water (50% by mass or more). Listed as the components other than water may be organic solvents which dissolve in water including, for example, methanol, ethanol, isopropanol, butanol, acetone, methyl-ethyl ketone, tetrahydrofuran. Of these, specifically preferable are alcohol-series organic solvents such as methanol, ethanol, isopropanol, butanol which do not dissolve the resin.

The colorant particles can be prepared by dispersing a colorant in the aqueous medium. The dispersion treatment of the colorant is carried out in the state where the concentration of the surfactant is not less than the critical micelle concentration (CMC) in water. Although the homogenizer used for the colorant dispersion treatment is not specifically limited, preferably listed are the ultrasonic homogenizer, mechanical homogenizer, pressure homogenizers such as Manton-Gaulin and pressure type homogenizer, sand grinder, media type homogenizers such as Getzmann mill and diamond fine mill. Further, the surfactant used herein may include that similar to the surfactant as described above. Incidentally, the colorant (particles) may be subjected to surface modification. The surface modification method of the colorant is as follows: the colorant is dispersed in a solvent and the surface modification agent is added, and then the resulting system is reacted by raising the temperature thereof. After the reaction is completed, the colorant is filtered and repeatedly cleaned with the same solvent, and then is dried to obtain a colorant (pigment) treated with the surface modification agent.

The salting-out/fusion-bonding method which is the preferred method is the process that a salting-out agent which is a metal salt such as an alkali metal salt or an alkaline earth metal salt is added as the flocculating agent of the critical flocculation concentration or more in water in which resin particles and colorant particles exist, and subsequently the resulting solution is heated to a temperature which is not lower than the glass transition point of the resin particle and also not lower than the melting peak temperature (° C.) of the ester compound having the specified structure to conduct salting-out, at the same time carrying out fusion-bonding. In this process, a method of effectively carrying out fusion-bonding by adding the organic solvent which is infinitely dissolvable in water to practically lower the glass transition temperature of the resin particle may be adopted. Examples of the alkali metal salt and alkaline earth metal salt usable for the salting-out agents include: salts of alkali metals, for example, lithium, potassium and sodium; and salts of alkaline earth metals, for example, magnesium, calcium, strontium and barium, of these preferable are salts of potassium, sodium, magnesium, calcium and barium. Listed as components of the salt may be, for example, chlorine salt, bromine salt, iodine salt, carbonate and sulfate. Further, listed as the organic solvents infinitely dissolvable in water may be, for example, methanol, ethanol, 1-propanol, 2-propanol, ethylene glycol, glycerin, acetone, and preferably the alcohols of methanol, ethanol, 1-propanol, 2-propanol, having not more than 3 carbon atoms, and specifically preferably 2-propanol.

The above salting-out step and the fusion-bonding step may also be carried out separately.

When the fusion-bonding is carried out by salting-out/fusion-bonding, a period of time for leaving the system after the salting-out agent is added is preferably as short as possible. Although the reason thereof is not clear, the following problems occur that depending on the leaving period of time after salting out, the flocculation state of the particles varies, because the particle distribution is unstable and the surface property of the fusion-bonded toner varies. Further, the temperature at which the salting-out agent is added is preferably not higher than the glass transition temperature of the resin particle. The reason thereof is that when the temperature at which the salting-out agent is added is not lower than the glass transition temperature of the resin particle, the salting-out/fusion-bonding of the resin particle proceed fast while the particle diameter cannot be controlled, so that the large diameter particles tends to be disadvantageously generated. The addition temperature may be not higher than the glass transition temperature of the resin, however, generally in the range of 5-55° C., and preferably 10-45° C.

In the present invention, the salting-out agent is added at the temperature not higher than the glass transition temperature of the resin particle, and then the temperature is raised as fast as possible to heat to the temperature which is not lower than the glass transition temperature of the resin particle as well as not lower than the melting peak temperature (° C.) of the ester compound having the specified structure. The period of time while the temperature is increase is preferably less than one hour. Further, the temperature raising is preferably carried out quickly, and the temperature raising speed is preferably 0.25° C./min or more. The maximum temperature raising rate is not specifically limited, however, when the temperature is immediately increased, the salting-out rapidly proceeds and the particle diameter may become difficult to be controlled, and thereby it is preferably 5° C./min or less. With this fusion-bonding process, a dispersion of the association particles (toner particles) containing the resin particles and any other particles being subjected to salting-out/fusion-bonding can be obtained.

The glass transition temperature of the resin particle and the melting peak temperature of the ester compound having the specified structure can be measured by using DSC-7 (differential scanning calorimeter manufactured by Perkin Elmer, Inc.) and TAC7/DX (thermal analysis controller manufactured by Perkin Elmer, Inc.). The analysis procedure includes precise weighing a toner to be 4.5-5.0 mg to two places of decimals; enclosing the toner into an aluminum pan (Kit No. 0219-0041) and setting the pan on the sample-holder; and preparing a blank aluminum pan as a reference. The measurement conditions are as follows: the measurement temperature range of 0-200° C., the temperature increasing speed of 10° C./min and the temperature decreasing speed of 10° C./min. The temperature control is conducted so as to be 1st heating-1st cooling-2nd heating, and the analysis is based on the data in the 2nd heating. The glass transition temperature is the temperature at the intersection point of (1) the extension line of a base line before the endothermic peak temperature of the resin particle and (2) the tangential line giving the maximum inclination between the foot and the top of the endothermic peak. The melting peak temperature is indicated by a peak top temperature of the endothermic peak of the ester compound.

[Cooling Process]

This process is a process of subjecting the dispersion of the colored particles to the cooling treatment (quick cooling treatment). The condition of the cooling treatment is to cool at a cooling rate of 1-20° C./min. The method of the cooling treatment, although it is not specifically limited, may include a method of cooling by introducing a cooling medium from outside of a reaction container and a method of cooling by directly charging cool water into the reaction system.

[Solid-liquid Separation and Cleaning Process]

In the solid-liquid separation and cleaning process, the following treatments are applied: a solid-liquid separation treatment of subjecting the colored particles to solid-liquid separation from the dispersion of the colored particles having been cooled down to a prespecified temperature in the above process; and a cleaning treatment of removing deposits such as the surfactant and the salting-out agent from a toner cake (an aggregation substance with a cake-shape) having been subjected to solid-liquid separation. Herein, the filter treatment method, which is not specifically limited, may include the methods such as the centrifugal separation method, vacuum filtration method using Nutsche, and the filter method using a filter press.

[Drying Process]

This process is a process of subjecting the toner cake having been subjected to the cleaning treatment to the dry treatment to obtain dried colored particles. Listed as the dryer used in this process may be, for example, a spray dryer, a vacuum-freeze dryer, and a decompression dryer, and it is preferable to use a stationary rack-dryer, a movable rack-dryer, a fluidized dryer, a rolling dryer, an agitation dryer and other dryers. The water content of the dried colored particle is preferably 5% by weight or less, more preferably 2% by weight or less. Incidentally, when the toner particles having been subjected to the dry treatment are agglomerated with a weak intermolecular force among the particles, the agglomeration may be subjected to a powder treatment. Herein, mechanical type of powder machines such as a jet-mill, HENSCHEL MIXER, a coffee mill, a food processor may be used as the powder treatment machine.

[External Additive Treatment Process]

This process is a process of manufacturing the toner by mixing an external additive in the dried toner particles according to the necessity.

As the mixer for the external additive, mechanical type of mixers such as a HENSCHEL MIXER and a coffee mill may be used.

The volume median diameter ($Dv_{50}$) of the toner of the present invention is preferably 3-9 μm. The toner of the present invention preferably has a CV value in volume particle size distribution of the toner of not more than 20%.

A CV value in volume based particle distribution represents a degree of dispersion in volume particle distribution of toner particles, and is defined by the following equation. The smaller a CV value is, the sharper the particle distribution is; which means that the diameter of toner particles is uniform.

CV value=(standard deviation in volume particle distribution)/(volume median diameter ($Dv_{50}$))×100 The volume median diameter and the CV value of the toner are measured and calculated by using Coulter Multisizer III (produced by Beckman Coulter Inc.), connected with a computer system (produced by Beckman Coulter Inc.) for data processing.

Measurement is carried out as follows: A surfactant solution is prepared, for example, by 10 times diluting a commercially available neutral detergent containing a surfactant with pure water. 20 ml of the surfactant solution is mixed with 0.02 g of toner. After making the toner blended with the surfactant solution, the mixture is subjected to an ultrasonic dispersion for one minute to obtain a toner dispersion. The toner dispersion is then poured, using a pipette, in a beaker containing ISOTON II (diluent; produced by Beckman Coulter Inc.) placed in a sample stand, until the content shown in the monitor increased to 5% by weight. The count number of particles is set at 30,000 and a 50 μm aperture is used.

The toner of the present invention can be used as a black toner or a colored toner.

The compounds (a binder resin, a colorant, a release agent, a charge control agent, an external additive and a lubricant) which constitutes the toner of the present invention will now be explained.

(Binder Resin)

Examples of a polymerizable monomer forming the binder resin include: styrenes, for example, styrene, o-methylstyrene, m-methylstyrene, p-methylstyrene, α-methylstyrene, p-chlorostyrene, 3,4-dichlorostyrne, p-phenylstyrene, p-ethylstyrene, 2,4-dimethylstyrene, p-tert-butylstyrene, p-n-hexylstyrene, p-n-octylstyrene, a p-n-nonylstyrene, p-n-decylstyrene, and p-n-dodecyl styrene, and derivatives thereof; methacrylate derivatives, for example, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; acrylate derivatives, for example, methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins, for example, ethylene, propylene, and isobutylene; halogen-containing vinyls, for example, vinyl chloride, vinylidene chloride, vinyl bromide, and vinyl fluoride and vinylidene fluoride; vinyl esters, for example, vinyl propionate, vinyl acetate and vinyl benzoate; vinyl ethers, for example, vinyl methyl ether and vinyl ethyl ether; vinyl ketones, for example, vinyl methyl ketone, vinyl ethyl ketone and vinyl hexyl ketone; N-vinyl compounds, for example, N-vinylcarbazole, N-vinyl indole, and N-vinyl pyrrolidone; vinyl compounds, for example, vinyl naphthalene and vinyl pyridine; and acrylic acid or methacrylic acid derivatives, for example, acrylonirile, methacrylonitrile and acrylamide. These vinyl monomers may be used alone or may be used in combination.

Moreover, it is still more preferable to use a polymerizable monomer having an ionically dissociable group in combination with a polymerizable monomer which constitutes the resin. For example, preferable are monomers having, for example, a carboxyl group, a sulfonic acid group, and a phosphate group as the composition group of a monomer. Specific examples of the monomer include: acrylic acid, methacrylic acid, maleic acid, itaconic acid, cinnamic acid, fumaric acid, maleic acid mono-alkyl ester, itaconic acid mono-alkyl ester, styrene sulfonic acid, allylsulfosuccinic acid, 2-acrylamide-2-methylpropanesulfonic acid, acid phosphoxyethyl methacrylate, 3-chloro-2-acid phosphoxypropyl methacrylate.

Further, polyfunctional vinyls may be used to form a resin having a cross-linking structure, example of the polyfunctional vinyl including: divinylbenzne, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate and neopentylglycol diacrylate.

These polymerizables monomer can be polymerized using a radical polymerization initiator. In this case, an oil soluble polymerization initiator can be used in a suspension polymerization method. Examples of the oil soluble polymerization initiator include: azo or diazo polymerization initiators, for example, 2,2'-azobis-(2,4-dimethylvaleronitrile), 2,2'-azobis-isobutyronitrile, 1,1'-azobis-(cyclohexane-1-carbonitrile), 2,2'-azobis-4-methoxy-2,4-dimethylvaleronitrile and azobisisobutyronitrile; and peroxide polymerization initiators or polymer polymerization initiators having a peroxide group as a side chain, for example, benzoyl peroxide, methylethyl-ketone peroxide, diisopropyl peroxycarbonate, cumene hydroperoxide, t-butyl hydroperoxide, di-t-butyl peroxide, dicumyl peroxide, 2,4-dichloro benzoyl peroxide, lauroyl peroxide, 2,2-bis-(4,4-t-butyl peroxycyclohexyl)propane and tris(t-butyl peroxy)triazine.

When using an emulsion polymerization method, a water-soluble radical polymerization initiator can be used. Examples of a water-soluble polymerization initiator include: persulfates, for example, potassium persulfate and ammonium persulfate; azobis-aminodipropane acetate; azobis-cyanovaleric acid and its salt; and hydrogen peroxide.

(Colorant)

The colorant used in the present invention may be known inorganic or organic colorants. Specific colorants are listed below.

As the black colorant, for example, the carbon blacks such as furnace black, channel black, acetylene black, thermal black, and lampblack, and also the magnetic powders such as magnetite and ferrite are used.

Listed as the colorant for magenta or red include, for example: C. I. pigment red 2, C. I. pigment red 3, C. I. pigment red 5, C. I. pigment red 6, C. I. pigment red 7, C. I. pigment red 15, C. I. pigment red 16, C. I. pigment red 48;1, C. I. pigment 53;1, C. I. pigment 57;1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, C. I. pigment red 222 and the like.

Listed as the colorant for orange or yellow include, for example: C. I. pigment orange 31, C. I. pigment orange 43, C. I. pigment yellow 12, C. I. pigment yellow 13, C. I. pigment yellow 14, C. I. pigment yellow 15, C. I. pigment yellow 17, C. I. pigment yellow 93, C. I. pigment yellow 94, C. I. pigment yellow 138.

Listed as the colorant for green or cyan include, for example: C. I. pigment blue 15, C. I. pigment blue 15;2, C. I. pigment blue 15;3, C. I. pigment blue 15;4, C. I. pigment blue 16, C. I. pigment blue 60, C. I. pigment blue 62, C. I. pigment blue 66, C. I. pigment green 7.

Incidentally, these colorants may be used alone or may be used in combination of two or more of them, according to the necessity. The adding amount of the colorant is set to 1-30%. by weight, and preferably in the range of 2-20% by weight, based on the total weight of the toner.

(Release Agent)

The release agent used in the present invention is preferably the ester compound having the specified structure. The content of the ester compound having the specified structure is 1-15% by weight, and preferably 3-12% by weight, based on the total weight of the toner to obtain favorable results.

(Charge Control Agent)

In the toner of the present invention, a charge control agent may be added according to the necessity. As the charge control agent, known compounds may be used, specific examples of which include: a nigrosin dye, a metal salt of naphthenic acid or higher fatty acid, an alkoxylated amine, a quaternary ammonium chloride, an azo metal-complex, a salicylate metal salt or its metal-complex. Listed as the metal to be contained therein are, for example, Al, B, Ti, Fe, Co, Ni. Specifically preferable compound as a charge control agent is the metal-complex compound of benzilic acid derivatives. Incidentally, when the content of the charge control agent is 0.1-20.0% by weight based on the total weight of the toner, favorable results may be obtained.

(External Additive)

An external additive may be mixed and used in the toner particles for the purpose of improving the charge property and increasing the cleaning property and other purposes. The external agent is not specifically limited and various types of inorganic particles, organic particles, and lubricants may be used.

As the inorganic particles, known particles may be used. More specifically, particles of silica, titania, alumina, strontium titanate may preferably be used. These inorganic particles that are subjected to the hydrophobic treatment may be used according to the necessity. Listed as the specific silica particles may be, for example, the commercially available products manufactured by Nippon Aerosil Co., Ltd., for example, R-805, R-976, R-974, R-972, R-812 and R-809; HVK-2150, H-200 manufactured by Hoechst AG; the commercially available products manufactured by Cabot Corp. such as TS-720, TS-530, TS-610, H-5 and MS-5.

Listed as the titania particles may be, for example, the commercially available products manufactured by Nippon Aerosil Co., Ltd. such as T-805, T-604; the commercially available products manufactured by Tayca Co., Ltd. such as MT-100S, MT-100B, MT-500BS, MT-600, MT-600SS, JA-1;

the commercially available products manufactured by Fuji Titan Co., Ltd. such as TA-300SI, TA-500, TAF-130, TAF-510, TAF-510T; the commercially available products manufactured by Idemitsu Kosan Co., Ltd. such as IT-S, IT-OA, IT-OB, IT-OC and the like.

Listed as the alumina particles may be, for example, commercially available products manufactured by Nippon Aerosil Co., Ltd. such as RFY-C, C-604; the commercially available product manufactured by Ishihara Sangyo Kaisha Ltd. such as TTO-55 and the like.

Further, as the organic particles, those having a number average primary particle diameter of about 10 through 2000 nm with a spherical shape may be used. More specifically, homopolymers such as styrene and methyl methacrylate and their copolymer may be used.

The adding amount of these external additives is preferably 0.1 through 10.0% by weight based on the total weight of the toner. As the method of adding the external additive, various types of known mixers may be used such as, a turbular mixer, a HENSCHEL MIXER, a Nauter mixer, and a V-type mixer.

(Lubricant)

In the toner of the present invention, a lubricant may be mixed and used in the toner particles for the purpose of increasing the cleaning property and transfer property according to the necessity. Listed as the lubricant may be, for example, the metal salts of higher fatty acid such as the salts of zinc stearate, aluminum stearate, copper stearate, magnesium stearate, calcium stearate; the salts of zinc oleate, manganese oleate, iron oleate, copper oleate, magnesium oleate; the salts of zinc palmitate, copper palmitate, magnesium palmitate, calcium palmitate; the salts of zinc linoleate, calcium linoleate; the salts of zinc ricinoleate, calcium ricinoleate.

The adding amount of these lubricants is preferably 0.1 through 10.0% by weight based on the total weight of the toner. As the method of adding the lubricant, various types of known mixers may be used such as a turbular mixer, a HENSCHEL MIXER, a Nauter mixer, and a V-type mixer.

The toner of the present invention may be used as a mono-component developer or a two-component developer. When used as the mono-component developer, the toner may be formed as a magnetic mono-component developer in which magnetic particles of about 0.1 through 0.5 μm is contained or may be used as a non-magnetic mono-component developer. Further, the toner may be used as the two-component developer by mixing with a carrier. In this case, as the magnetic particles of the carrier, known materials represented by iron-containing magnetic particles such as iron, ferrite, and magnetite may be used, of these, specifically preferable is the ferrite particle or the magnetite particle. The volume median diameter ($Dv_{50}$) of the above magnetic particles is preferably 15-100 μm, and more preferably 20-80 μm.

The median diameters ($Dv_{50}$) of the carrier particles are determined by using a laser diffraction particle diameter distribution meter "HELOS" (manufactured by Sympatec GmbH).

As the carrier, a coating carrier in which the magnetic particles are further coated with a resin, or a so-called resin dispersion type carrier in which the magnetic particles are dispersed in a resin is preferable. The resin composition for coating is not specifically limited. Examples of the resin for coating magnetic particles include: an olefin resin, a styrene resin, a styrene-acrylic resin, a silicon-containing resin, an ester resin or a fluorine-containing polymer resin. The resin for dispersing magnetic particles is not specifically limited and known resins may be used including, for example, a styrene-acrylic resin, a polyester resin, a fluorine-containing resin and a phenol resin.

Further, the mixing ratio of the carrier to the toner is preferably in the range of carrier: toner=1:1 through 50:1 in weight ratio.

The toner of the present invention is preferably used in an image forming apparatus based on the contact fixing method in which a transfer material having thereon a toner image is passed between heat members composing a fixing device to fix the image.

The image forming apparatus and the fixing device will be described below.

FIG. 1 is a cross-sectional view showing an example of an image forming apparatus used in the present invention.

In FIG. 1, 20Y (20M, 20C, 20Bk) represents a image forming unit, 21Y (21M, 21C, 21Bk) represents a photosensitive drum, 22Y (22M, 22C, 22Bk) represents a scorotron charger, 23Y (23M, 23C, 23Bk) represents an optical system for exposure, 24Y (24M, 24C, 24Bk) represents a developer, 25Y (25M, 25C, 25Bk) represents a cleaning device, 34Y (34M, 34C, 34Bk) represents a transfer device, 40 represents a fixing device, 115 represents a transfer material conveying belt, 160 represents a conveying device and P represents a transfer material.

The image forming apparatus illustrated in FIG. 1 will now be explained.

In the image forming unit shown in FIG. 1, four image forming units 20Y, 20M, 20C and 20Bk are provided along the transfer material conveying belt 115.

Each image forming unit includes: a photosensitive drum 21Y (21M, 21C, 21Bk), a scorotron charger 22Y (22M, 22C, 22Bk), an optical system for exposure 23Y (23M, 23C, 23Bk), a developer 24Y (24M, 24C, 24Bk) and a cleaning device (a cleaning means) 25Y (25M, 25C, 25Bk), and each toner image formed on each photosensitive drum (21Y, 21M, 21C, 21Bk) is sequentially transferred onto a transfer material P (for example, a transfer sheet and an OHP sheet) which is synchronizedly conveyed to form a superimposed color image.

A transfer material P is conveyed by the transfer material conveying belt 115 and then separated from the conveying belt with the aid of the AC static eliminator 161 and a separating claw 210 which intermittently appears on the conveying device 160.

After passing through the conveying device 160, the transfer material P is sent to the fixing device (fixing means) 40 and wedged at the nip T formed between the heating roller 41 and the pressing roller 42 where heat and pressure are applied to fix the superimposed color image formed on the transfer material P and then discharged out of the apparatus.

The exposure device may be equipped with a scanning optical system employing semiconductor laser or a solid state scanner, for example, LED and a liquid crystal shutter.

As the material for the transfer material conveying belt 115, employed are polymer films, for example, polyimide and polycarbonate, and PVDF or electro conductive rubbers prepared by adding conductive fillers such as carbon black into synthetic rubbers such as silicone rubber or fluorine-containing rubber. The shape of the belt may be drum-like or belt-like, however, preferable is belt-like in view of the flexibility in device designing.

The surface of the transfer image conveying belt 115 is preferably moderately roughened. By roughening the surface of the belt so as to exhibit a 10 points surface roughness Rz of 0.5-2 μm, the contact between the transfer material and the belt is improved and the movement of the transfer material on the belt is suppressed resulting in improving the transferability of the toner image from the photosensitive drum to the transfer material.

The transfer material used in the present invention is a support body for keeping the toner image, which is generally called as an image support body, a transfer body or a transfer sheet. More specifically, different types of transfer materials may be listed including plain papers from thin paper to thick paper, fine-quality paper, printing paper such as art paper and coated paper, Japanese paper and postcard paper which are commercially available, plastic film for OHP, and cloth, but the transfer material is not limited thereto.

Figure 2:
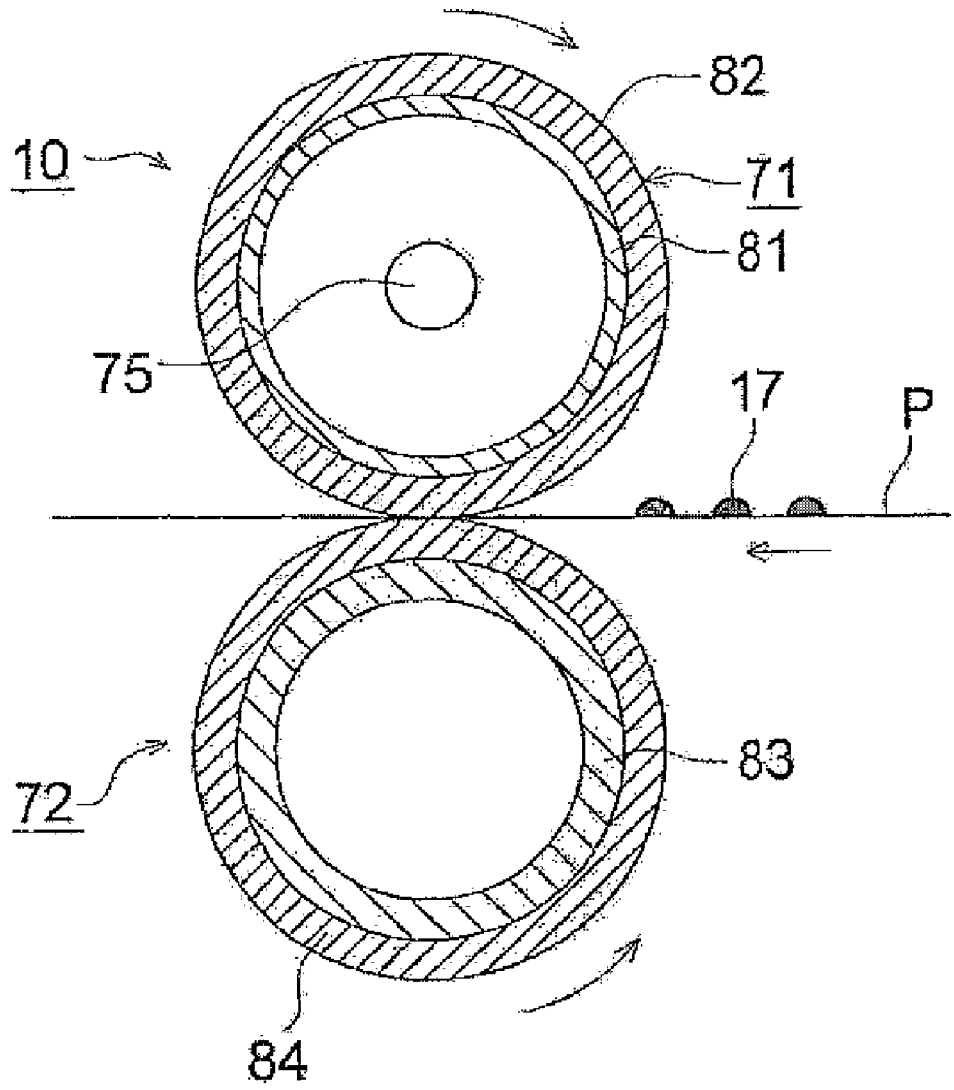
FIG. 2 is a cross-sectional view showing an example of a fixing device (of a type using a pressure roller and a heat roller) used in the present invention.

FIG. 2 is a cross-sectional view showing an example of the fixing device 10 (a type of using a pressure roller and a heat roller) used in the present invention.

The fixing device 10 shown in FIG. 2 contains a heat roller 71 and a pressure roller 72 abutting the heat roller 71. Incidentally, in FIG. 2, reference numeral 17 denotes a toner image formed on the transfer material P (transfer sheet).

The heat roller 71 contains a coating layer 82 made of a fluorocarbon resin or an elastic body formed on a surface of a cored bar 81, the heat roller 71 further containing a heat member 75 made of a linear heater.

The cored bar 81 is composed of a metal and the inner diameter thereof is preferably 10-70 mm. The metal composing the cored bar 81 is not specifically limited, and such metals may be listed including, for example, iron, aluminum, copper or alloys of these metals.

The wall thickness of the cored bar 81 is preferably 0.1-15 mm, which is determined considering the balance between the requirement of energy saving (making the wall thinner) and the strength (depending on the component materials). For example, in order to keep the strength equivalent to that of the cored bar made of 0.57 mm thickness iron by the cored bar made of aluminum, the thickness of 0.8 mm is required.

As the fluorocarbon resin composing a surface of the coating layer 82, for example, PTFE (polytetrafluoroethylene) and PFA (tetrafluoroetylene-perfluoroalkylvinylether copolymer) may be listed.

The thickness of the coating layer 82 made of fluorocarbon resin is preferably 10-500 μm, and more preferably 20-400 μm.

When the thickness of the coating layer 82 containing fluorocarbon resin is less than 10 μm, the function as the coating layer cannot be adequately performed, so that the durability as the fixing device cannot be assured. On the other hand, the surface of the coating layer over 500 μm tends to have bruises due to paper powders, and the toner or other materials adheres at the bruise portions, causing the problem of image staining.

Further, as the elastic body composing the coating layer 82, a silicon rubber and a silicon sponge rubber having high heat resistance, for example, LTV, RTV and HTV are preferably used.

An Asker C hardness of the elastic body composing the coating layer 82 is preferably less than 80°, and more preferably less than 60°.

Further, the thickness of the coating layer 82 made of the elastic body is preferably 0.1-30 mm, and more preferably 0.1-20 mm.

As the heat member 75, a halogen heater is preferably used.

The pressure roller 72 contains a coating layer 84 made of an elastic body formed on a surface of a cored bar 83. The elastic body composing the coating layer 84 is not specifically limited, and various types of soft rubbers and sponge rubbers, for example, polyurethane rubber and silicon rubber are usable. Silicon rubber or silicon sponge rubber are preferably used as a material used for the coating layer 84.

Further, the thickness of the coating layer 84 is preferably 0.1-30 mm, and more preferably 0.1-20 mm.

Further, the fixing temperature (the surface temperature of the heat roller 10) is preferably 70-210° C., and the fixing linear velocity is preferably 80-640 mm/sec. The nip width of the heat roller is preferably 8-40 mm, and more preferably 11-30 mm.

Incidentally, the heat roller may be coated with a silicon oil of not more than 0.3 mg per print, or may be used oil-less.

Figure 3:
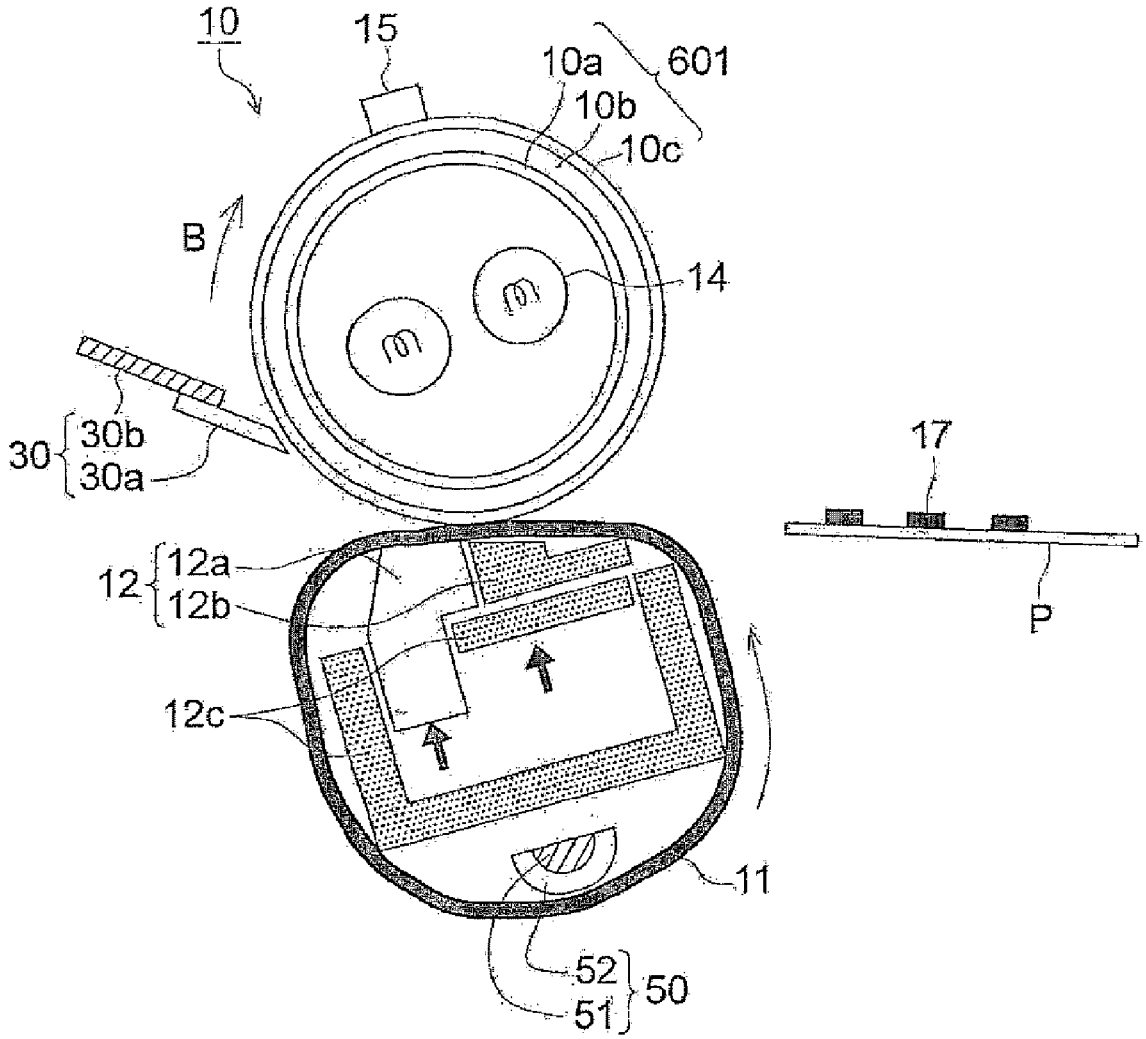
FIG. 3 is a schematic view showing an example of the fixing device (of a type using a belt and the heat roller) used in the present invention.

FIG. 3 is a schematic view showing an example of the fixing device (a type using a belt and a heat roller).

The fixing device 10 shown in FIG. 3 is a type using a belt and the heat roller for keeping the nip width, wherein the key section contains a fixing roller 601 and a seamless belt 11, a pressure pads (pressure members) 12*a*, 12*b* which are pressed against the fixing roller 601 via the seamless belt 11, and a lubricant supplying member 40. B represents the rotation direction of the fixing roller 601.

The fixing roller 601 contains a heat resistant elastic body layer 10*b* and a releasing layer (heat resistant resin layer) 10*c* which are formed around a metal core (cylindrical cored bar) 10*a*, wherein inside the core 10*a* is provided with the halogen lamp 14 as the heat source. The temperature of a surface of the fixing roller 601 is measured with the temperature sensor 15, and the halogen lamp is feedback-controlled by a temperature controller not shown in response to the measured signal, whereby the surface of the fixing roller 601 is controlled so that the temperature thereof is constant. The seamless belt 11 is contacted as to be wound by a prespecified angle relative to the fixing roller 601 to form a nip section.

Inside the seamless belt 11 is provided with a pressure pad 12 having a low friction layer on a surface thereof in the state of being pressed against the fixing roller 601 via the seamless belt 11. The pressure pad 12 contains the pressure pad 12*a* to which a strong nip pressure is applied and the pressure pad 12*b* to which a weak nip pressure is applied, the pressure pads 12*a*, 12*b* being held by a holder 12*c* made of metal or other materials.

The holder 12*c* is further mounted with a belt-travel guide so that the seamless belt 11 can slide and rotate smoothly. Because the belt-travel guide chafes against an inner surface of the seamless belt 11, a member for the belt-travel guide is desired to have a lower friction coefficient and also has a low heat conduction in order not to take the heat away from the seamless belt 11. As a specific example of the material of the seamless belt, polyimide is preferably used.

The lubricant supplying member 50 includes a lubricant reservoir 51 and a lubricant transmission controlling film 52. The lubricant reservoir 51 has many continuous pores, and, for example, felt or sponge is preferably used. The lubricant reservoir 51 is impregnated with lubricant including silicone oil and fluorine-containing oil. The lubricant permeation controlling film 52 has many continues pores, and, for example, a stretched fluorine-containing resin film is preferably used. In order to ensure the peeling of transfer materials from the fixing roller 601, a peeling member 30 as a supplementary member for the peeling may be provided on downstream of the nip section of the fixing roller 601. The peeling member 30 is held by holder 30*b* so that a peeling baffle 30*a* faces against rotating direction of the fixing roller 601 and is close to the fixing roller 601.

Figure 4:
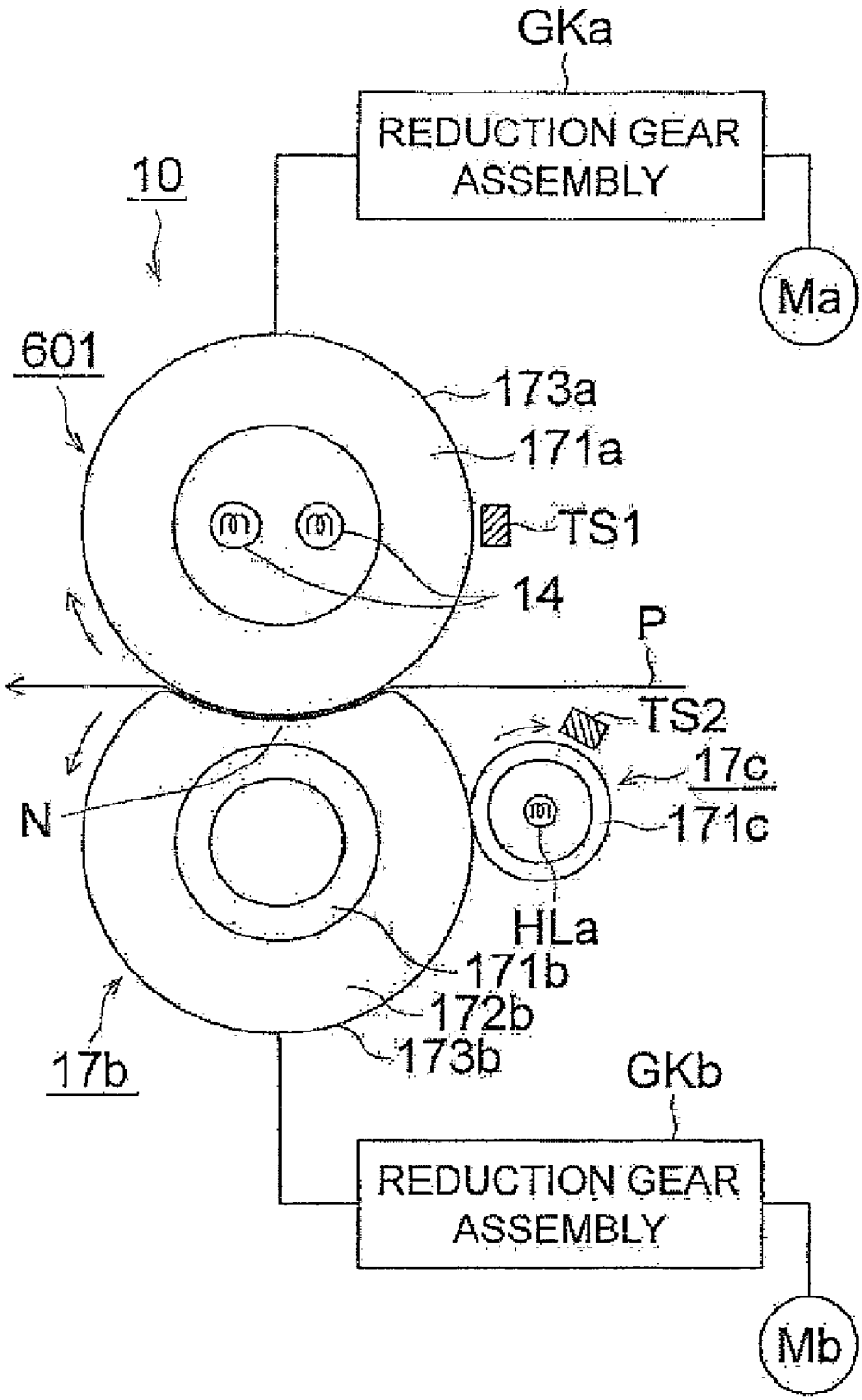
FIG. 4 is a schematic view showing an example of the fixing device (of a type using a soft roller and the heat roller) used in the present invention.

FIG. 4 is a schematic view showing an example of the fixing device (a type using a soft roller and a heat roller) used in the present invention.

The fixing device 10 shown in FIG. 4 is the type using the soft roller and the heat roller, which ensures a fixing nip while preventing the transfer material from winding to the roller, and provides excellent image quality. The fixing device 10 includes, a heat roller 601 as a heating member, a pressing roller 17*b* as a soft roller member and the halogen lamp 14 as a heat source inside the heat roller 601.

In the fixing device 10, a nip section N is formed between the heat roller 601 and the pressing roller 17*b*, and when heat and pressure are applied through the nip section N, a toner image is fixed on the transfer material P. Herein, a halogen lamp (not shown) may also be provided as a heat member inside the pressing soft roller.

The heat roller 601 including a halogen heater 14 inside as heating device is a hard roller having a major diameter of 50-80 mm. The hard roller has a metal base and a releasing layer provided thereon, wherein the metal base is, for example, a cylindrical metal pipe 171*a* containing aluminum and having a wall thickness of 5 to 20 mm, and the releasing layer 173*a* provided on the surface of the metal pipe 171*a* is formed by applying PFA (perfluoroalkoxy) or using a PFA tube and has a thickness of 5-30 μm.

The heat roller 601 is independently driven by actuating motor Ma through a reduction gear assembly Gka.

The pressing roller 17*b* as pressing device includes a cylindrical metal pipe 171*b*, a rubber layer 172*b* and a releasing layer 173*b*. The cylindrical metal pipe 171*b* is made of, for example, iron and has a wall thickness of 5-10 mm. The rubber layer 172*b* is formed on the cylindrical metal pipe 171*b* and made of a soft rubber, for example, a silicone rubber of the thickness of 3-15 mm, the rubber exhibiting the strength of 30 Hs to 50 Hs (A-type rubber strength in JIS). The releasing layer 173*b* is formed on the rubber layer 172*b*, by applying, for example, PFA or using, for example, a PFA tube. The thickness of the releasing layer 173*b* is preferably 15-100 μm. Thus prepared pressing roller 17*b* is a soft roller having a major diameter of 50-80 mm. The pressing roller 17*b* is also independently driven by an actuating motor Mb through a reduction gear assembly Gkb.

On a circumference of the pressing roller 17*b*, a supplementary roller 17*c* having a halogen lamp HLa inside as a heating member is provided on the upstream of nip section N of the heat roller 601 and the pressing roller 17*b*.

The supplementary roller 17*c* has a metal pipe 171*c* and a halogen lamp HLa, wherein the metal pipe 171*c* is a cylindrical core metal having a major diameter of 1 to 3 mm and provided thereon a PFA (perfluoroalkoxy) coating, and the halogen lamp HLa is provided inside of the metal pipe 171*c*.

The supplementary roller 17*c* is pressed onto the pressing roller 17*b* with a spring (not shown in the figure) and driven along with the rotation of the pressing roller 17*b*.

The toner image or the toner color image formed on the recording paper (transfer material P) is fixed at the convex curved nip section N formed between the heat roller 601 which is a hard roller and the pressing roller 17*b* which is a soft roller.

A contacting or non-contacting temperature sensor TS1 to the heat roller 601 is provided to control the temperature of the heat roller 601. The temperature of the supplementary roller 17*c* is controlled using a contacting or non-contacting temperature sensor TS2 to the supplementary roller 17*c*.

EXAMPLES

The present invention will be specifically described with reference to examples. However, the embodiments of the present invention are not limited thereto.

<Preparation of Ester Compounds Having a Specified Structure>

Polyvalent carboxylic acid and long-chain aliphatic alcohol having 10 through 30 carbon atoms were subjected to the dehydration and condensation reaction to produce compounds (1)-(7).

The reaction was carried out under nitrogen atmosphere at 220° C. for 8 hours, and after the reaction was completed, the resulting system was cooled down to 80° C. at a cooling rate of 20° C./min, being subjected to the neutralization reaction in the potassium hydroxide solution, and then subjected to cleaning, dehydration, and filtering to obtain the above compounds.

<Preparation of Toners>

(Preparation of Colored Particle Bk1)

(1) Preparation of Low Molecular Weight Latex:

Charged into a 1 liter four-flask equipped with a mixer, a cooling tube and a temperature sensor were 509.83 g of styrene, 88.67 g of n-butyl acrylate, 34.83 g of methacrylic acid, 21.83 g of tert-dodecyl mercaptan, and 66.7 g of the ester compound (1) having the specified structure, with the inner temperature raised to 80° C., the contents of the flask were stirred until the ester compound (1) was dissolved and then the temperature was kept constant. On the other hand, surfactant solution in which 1.0 g of sodium dodecylbenzenesulfonate was dissolved in 2700 ml of deionized water was similarly heated so that the inner temperature was raised to 80° C. and kept constant. With stirring, the surfactant solution kept at 80° C. was added with the monomer solution with the ester compound (1) dissolved therein, and the resulting solution was emulsified using an ultrasonic emulsifying device to obtain an emulsified liquid. Next, charged into a 5-liter four-necked flask equipped with a mixer, a cooling tube, a nitrogen introduction tube and a temperature sensor was the emulsified liquid, and under a flow of nitrogen with the inner temperature kept to 70° C., and the content of the flask was added with polymerization initiator solution in which 7.52 g of ammonium persulfate was dissolved in 500 ml of deionized waster with stirring, and the resulting solution was polymerized for 4 hours, followed by cooled down to a room temperature and filtered to obtain a latex. After the reaction, the polymerization residue was not observed and stable latex was obtained. This was represented as "latex (L-1)".

For the obtained "latex (L-1)", the number average primary particle diameter was measured using an electrophoresis light scattering photometer "ELS-800" (manufactured by Otsuka Electronics. Co., Ltd.) and determined to be 125 nm. The glass transition temperature was measured by DSC and determined to be 58° C. Further, the solid content density of the above latex measured based on the dry weighing method by the rack drying was 20% by weight.

(2) Preparation of High Molecular Weight Latex:

Charged into a 500 ml four-necked flask equipped with a mixer, a cooling tube and a temperature sensor were 92.47 g of styrene, 30.4 g of n-butyl acrylate, 3.80 g of methacrylic acid, 0.12 g of tert-dodecyl mercaptan, and 13.34 g of the ester compound (1) having the specified structure, with the inner temperature raised to 80° C., the contents of the flask were stirred until the ester compound (1) was dissolved and then the temperature was kept constant. On the other hand, surfactant solution in which 0.27 g of sodium dodecylbenzenesulfonate was dissolved in 540 ml of deionized water was similarly heated so that the inner temperature was to 80° C. and kept constant. With stirring, the surfactant solution kept at 80° C. was added with the monomer solution with the ester compound (1) dissolved therein, and the resulting solution was emulsified using the ultrasonic emulsifying device to obtain an emulsified liquid. Next, charged into a 5-liter four-necked flask equipped with a mixer, a cooling tube, a nitrogen introduction tube and a temperature sensor was the emulsified liquid, and under a flow of nitrogen with the inner temperature thereof kept to 70° C., the content of the flask was added with polymerization initiator solution in which 0.27 g of ammonium persulfate was dissolved in 100 ml of deionized waster with stirring, and the resulting solution was polymerized for 4 hours followed by cooled down to a room temperature and filtered to obtain a latex. After the reaction, the polymerization residue was not observed and stable latex was obtained. This was represented as "latex (H-1)".

For the obtained "latex (H-1)", the number average primary particle diameter was measured using the electrophoresis light scattering photometer "ELS-800" (manufactured by Otsuka Electronics Co., Ltd.) and determined to be 108 nm. The glass transition temperature was measured by DSC and determined to be 59° C. Further, the solid content of the latex measured based on the dry weighing method by the rack drying was 20% by weight.

(3) Preparation of Colored Particle Bk:

Charged into a 5-liter four-necked flask equipped with a mixer, a cooling tube and a temperature sensor were 250 g of the latex (H-1), 1000 g of the latex (L-1), 900 ml of deionized water, and a carbon black dispersion containing 20 g of carbon black "REGAL 330R" (manufactured by Cabot Corp.) dispersed in a surfactant solution (a solution in which 9.2 g of sodium dodecylsulfate was dissolved in 160 ml of deionized water), and, with stirring, the contents of the flask were added with 5N sodium hydroxide solution to adjust the pH to 10. Further, with stirring, the resulting solution was added with a solution with 28.5 g of magnesium chloride 6-hydrate dissolved in 1000 ml of deionized water under the room temperature, in which the inner temperature was then raised to 95° C. While the inner temperature was kept at 95° C., the volume median diameter ($Dv_{50}$) was measured using "COULTER MALTISIZER III" (manufactured by BECKMAN COULTER, Inc.). At the time when the particle diameter was 6.5 μm, a solution with 80.6 g of sodium chloride dissolved in 700 ml of deionized water was added, and the reaction was further continue for 6 hours with the inner temperature kept at 95° C. After the reaction was completed, the obtained dispersion of the associated particles (95° C.) was cooled to 45° C. in 10 minutes (cooling speed=5° C./min.). The associated particles (colored particle Bk) prepared as described above were filtered, cleaned through repeating resuspension to deionized water and filtering, and then dried to obtain colored particle Bk. This was represented as "colored particle Bk1". The median diameter and CV value of "colored particle Bk1" were measured by "COULTER MALTISIZER III" (manufactured by BECKMAN COULTER, Inc.), and determined to be as follows: median diameter ($Dv_{50}$)=6.5 μm, CV value=18.2%.

(Preparation of Colored Particle Bk2)

"Colored particle Bk2" was prepared in the same manner as colored particle Bk1 except that 100 g of the ester compound (1) having the specified structure was used in the preparation of low molecular weight latex instead of 66.7 g of the ester compound (1) used in the preparation of the colored particle Bk1, and 18.50 g of the ester compound (1) was used in the preparation of high molecular weight latex instead of 13.34 g of the ester compound (1) used in the preparation of the colored particle Bk1.

(Preparation of Colored Particle Bk3)

"Colored particle Bk3" was prepared in the same manner as colored particle Bk1 except that 20.0 g of the ester compound (1) having the specified structure was used in the preparation of low molecular weight latex instead of 66.7 g of the ester compound (1) used in the preparation of the colored particle Bk1, and 4.00 g of the ester compound (1) was used in the preparation of high molecular weight latex instead of 13.34 g of the ester compound (1) used in the preparation of the colored particle Bk1.

(Preparation of Colored Particle Bk4)

"Colored particle Bk4" was prepared in the same manner as colored particle Bk1 except that the ester compound (2) having the specified structure was used instead of the ester compound (1) having the specified structure used in the preparation of the colored particle Bk1.

(Preparation of Colored Particle Bk5)

"Colored particle Bk5" was prepared in the same manner as colored particle Bk1 except that 14.2 g of the ester compound (3) having the specified structure was used in the preparation of low molecular weight latex instead of 66.7 g of the ester compound (1) used in the preparation of the colored particle Bk1, and 2.80 g of the ester compound (3) was used in the preparation of high molecular weight latex instead of 13.34 g of the ester compound (1) used in the preparation of the colored particle Bk1.

(Preparation of Colored Particle Bk6)

"Colored particle Bk6" was prepared in the same manner as colored particle Bk1 except that 50.10 g of the ester compound (4) having the specified structure was used in the preparation of low molecular weight latex instead of 66.7 g of the ester compound (1) used in the preparation of the colored particle Bk1, and 10.21 g of the ester compound (4) was used in the preparation of high molecular weight latex instead of 13.34 g of the ester compound (1) used in the preparation of the colored particle Bk1.

(Preparation of Colored Particle Bk7)

"Colored particle Bk7" was prepared in the same manner as colored particle Bk1 except that the ester compound (6) having the specified structure was used instead of the ester compound (1) having the specified structure used in the preparation of the colored particle Bk1.

(Preparation of Colored Particle Bk8)

"Colored particle Bk8" was prepared in the same manner as colored particle Bk1 except that the ester compound (7) having the specified structure was used in the preparation of low molecular weight latex instead of the ester compound (1) used in the preparation of the colored particle Bk1, and the ester compound (7) having the specified structure was used in the preparation of high molecular weight latex instead of the ester compound (1) used in the preparation of the colored particle Bk1.

(Preparation of Colored Particle Bk9)

"Colored particle Bk9" was prepared in the same manner as colored particle Bk1 except that 50% of the ester compound (2) having the specified structure and 50% of the ester compound (2) having the specified structure were used together instead of the ester compound (1) having the specified structure used in the preparation of the colored particle Bk1.

(Preparation of Colored Particle Bk10)

"Colored particle Bk10" was prepared in the same manner as colored particle Bk1 except that Comparative compound (1) was used instead of the ester compound (1) having the specified structure used in the preparation of the colored particle Bk1.

Comparative compound (1)

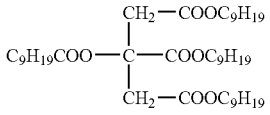

(Preparation of Colored Particle Bk11)

"Colored particle Bk11" was prepared in the same manner as colored particle Bk1 except that Comparative compound (2) was used instead of the ester compound (1) having the specified structure used in the preparation of the colored particle Bk1.

Comparative compound (2)

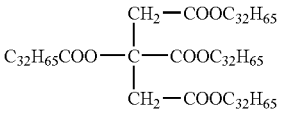

(Preparation of Colored Particle Bk12)

"Colored particle Bk12" was prepared in the same manner as colored particle Bk1 except that Comparative compound (3) was used instead of the ester compound (1) having the specified structure used in the preparation of the colored particle Bk1.

Comparative compound (3)

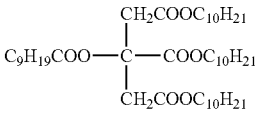

(Preparation of Colored Particle Bk13)

"Colored particle Bk13" was prepared in the same manner as colored particle Bk1 except that Comparative compound (4) was used instead of the ester compound (1) having the specified structure used in the preparation of the colored particle Bk1.

Comparative compound (4)

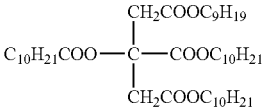

(Preparation of Colored Particle Bk14)

"Colored particle Bk14" was prepared in the same manner as colored particle Bk1 except that Carnauba wax was used instead of the ester compound (1) having the specified structure used in the preparation of the colored particle Bk1.

(Preparation of Colored Particles C1-C14)

Colored particles C1-C14 were prepared in the same manner as colored particles Bk1-Bk14 except that 10 g of C. I. pigment blue 15;3 was used instead of 20 g of REGAL 330R (manufactured by Cabot Corp.) used in colored particles Bk1-Bk14.

(Preparation of Colored Particles M1-M14)

Colored particles M1-M14 were prepared in the same manner as colored particles Bk1-Bk14 except that 17 g of C. I. pigment red 122 was used instead of 20 g of REGAL 330R (manufactured by Cabot Corp.) used in colored particles Bk1-Bk14.

(Preparation of Colored Particles Y1-Y14)

Colored particles Y1-Y14 were prepared in the same manner as colored particles Bk1-Bk14 except that 18 g of C. I. pigment yellow 17 was used instead of 20 g of REGAL 330R (manufactured by Cabot Corp.) used in colored particles Bk1-Bk14.

The amounts, volume median diameters, CV values of the ester compounds having the specified structure used for colored particles Bk1-Bk14 are listed in Table 1.

TABLE 1

| Colored-particle No. | Ester compound having specified structure: Low molecular weight latex: Compound | Quantity (g) | High molecular weight latex: Compound | Quantity (g) | Median diameter ($Dv_{50}$) (μm) | CV value (%) |
|---|---|---|---|---|---|---|
| 1 | (1) | 66.70 | (1) | 13.34 | 6.4 | 18.2 |
| 2 | (1) | 100.00 | (1) | 18.50 | 6.6 | 17.8 |
| 3 | (1) | 20.00 | (1) | 4.00 | 6.4 | 18.5 |
| 4 | (2) | 66.70 | (2) | 13.34 | 6.5 | 18.1 |
| 5 | (3) | 14.20 | (3) | 2.80 | 6.3 | 18.3 |
| 6 | (4) | 50.10 | (4) | 10.21 | 6.5 | 18.1 |
| 7 | (6) | 66.70 | (6) | 13.34 | 6.4 | 18.1 |
| 8 | (7) | 66.70 | (7) | 13.34 | 6.6 | 18.2 |
| 9 | (2) + (5) (1:1) | 66.70 | (2) + (5) (1:1) | 13.34 | 6.6 | 17.9 |
| 10 | Comparative compound (1) | 66.70 | Comparative compound (1) | 13.34 | 6.2 | 17.8 |
| 11 | Comparative compound (2) | 66.70 | Comparative compound (2) | 13.34 | 6.6 | 17.5 |

TABLE 1-continued

| Colored-particle No. | Ester compound having specified structure: Low molecular weight latex Compound | Quantity (g) | High molecular weight latex Compound | Quantity (g) | Median diameter ($Dv_{50}$) (μm) | CV value (%) |
|---|---|---|---|---|---|---|
| 12 | Comparative compound (3) | 66.70 | Comparative compound (3) | 13.34 | 6.5 | 17.8 |
| 13 | Comparative compound (4) | 66.70 | Comparative compound (4) | 13.34 | 6.4 | 17.9 |
| 14 | Carnauba wax | 66.70 | Carnauba wax | 13.34 | 6.5 | 17.6 |

The data for Colored particles C1-C14, M1-M14 and Y1-Y14 were similar to those for colored particles Bk1-Bk14, therefore, listing was abbreviated.

(External Additive Treatment of the Toner Particles)

Next, each of the colored particles prepared as described above was added with 1% by weight of hydrophobic silica (the number average primary particle diameter=12 nm, the hydrophobic ratio=68) and 1 by weight of hydrophobic titanium oxide (the number average primary particle diameter=20 nm, the hydrophobic ratio=63), and was mixed using "HENSCHEL MIXER" (manufactured by Mitsui Miike Co., Ltd.). Subsequently, coarse particles were removed using a sieve of aperture 45 μm to prepare toners Bk1-Bk14, C1-C14, M1-M14 and Y1-Y14. These were referred to as Examples Bk1-Bk9, Examples C1-C9, Examples M1-M9 and Examples Y1-Y9; and Comparative examples Bk1-Bk5, Comparative examples C1-C5, Comparative examples M1-M5 and Comparative examples Y1-Y5.

<Preparation of Developers>

Each of the toners prepared as described above was mixed with a ferrite carrier coated with silicon resin and having volume median diameters ($Dv_{50}$) of 60 μm so that the content of each of the toners was 6% by weight to prepare Developers Bk1-Bk14, Developers C1-C14, Developers M1-M14 and Developers Y1-Y14.

<Evaluation Device>

The fixing device in FIG. 3 was mounted to the image forming apparatus described in FIG. 1 to use as the evaluation device. Incidentally, the fixing rate and the heat roller surface temperature were designed to be set as described below.

Fixing rate: 280 mm/sec (about 50 A4 size sheets per minute when fed parallel to the short edge (long edge feed))

Heat roller surface temperature: arbitrary settable in the range of 90-240° C.

<Evaluation>

Using the above evaluation device, each of the toners and each of the developers were sequentially filled to carry out printing, and the evaluation was carried out on the following items.

<<Evaluation of the Fixable Temperature>>

The temperature of the transfer material immediately after discharged from the heat roll was varied from 90-200° C. at intervals of every 10° C. to produce fixed images under a condition of 20° C. and 50% RH. A4-size fine-quality paper (65 g/m$^2$) was used as the transfer material.

The fixable temperature was determined by evaluating the fixing strength of the obtained images with a mending tape stripping method described in "DENSHISYASHIN GIJYUTSU NO KISO TO OUYOU (Base and Application of Electrophotographic Technology): edited by Imaging Society of Japan" Chapter 9, Section 1.4. More specifically, the temperature of the transfer material surface was varied, and for each of the temperatures, a 2.54 cm square of fixed solid image with the toner amount of 0.6 mg/cm$^2$ was prepared, and the image densities of before and after the image stripping test using "Scotch Mending Tape" (manufactured by Sumitomo 3M Co., Ltd.) were measured, and the ratio of residual toner image was determined as the fixing ratio.

Tape Stripping Method:

(1) Measuring the absolute reflection density $D_0$ of a 5 mm square black solid.

(2) Lightly applying "Mending Tape" (equivalent to No. 810-3-12, manufactured by Sumitomo 3M Co., Ltd.).

(3) Rubing the tape 3.5 times in both ways with the pressure of 1 kPa.

(4) Striping the tape at the angle of 180° and with the strength of 200 g.

(5) Measuring the absolute reflection density $D_1$ after stripping.

(6) Fixing ratio=$100 \times D_1/D_0$ (%)

The fixable temperature was defined as the lowest temperature which gave a fixing ratio of 90% or more.

Reflection densitometer: RD-918 manufactured by GretagMacbeth was used for the image density measurement.

<<Evaluation of Fixing Offset>>

The temperature of the heat roller was set to 150° C.

Under a low-temperature and low-humidity condition (10° C., 20% RH), the continuous full color printing (total pixel density: 40%, pixel density of each color image: 10%) was carried out on 1000 sheets of A3-size fine-quality paper (65 g/m$^2$) with humidity controlled in the same environment, and a visual observation was made directly on the images and the heat roll surface after completion of the 1000-sheet printing and an evaluation was made from the degree of the toner adhesion generated on the printed images and the heat roll surface.

The temperature of the transfer material surface just after discharged was around 100° C.

Evaluation Criteria:

A: No offset was observed on the heat roller and the image.

B: Offset was observed only on the heat roller while no offset was observed on the image; suitable for practical use.

C: Stain due to the offset was observed on the image: not suitable for practical use.

<<Image Evaluation>>

The fixing rate was set to 280 mm/sec, and the temperature of the heat roller was set to 150° C. so that the temperature of the transfer material surface was controlled to be around 100° C.

Under a condition of 20° C., 50% RH), 100,000 sheets of A3-size full color printing of which pixel density was 4%, on fine-quality paper, (65 g/m$^2$) were intermittently carried out, followed by being left overnight. Then, further printing was carried out and densities and fogs of the first printed image and the continuously printed 100th printed image were evaluated.

<Image Density>

The density of the black solid image portion was evaluated based on the relative density (the density of the transfer material without being printed was set to 0.0). Reflection density meter "RD-918" (manufactured by GretagMacbeth) was used for the measurement.

<Fog>

The fog density of the white portion of the print transfer material was expressed as a relative density when the image density of white background portion of unused transfer material was set to 0.000. Reflection density meter "RD-918" (manufactured by GretagMacbeth) was used for the measurement.

The evaluation results were summarized in Table 2.

TABLE 2

| | Colored particle No. | Fixable temperature (° C.) | Fixing offset | Image density 1st/100th | Fog 1st/100th |
|---|---|---|---|---|---|
| Ex. 1 | Bk1, Y1, M1, C1 | 110 | A | 1.41/1.40 | 0.001/0.001 |
| Ex. 2 | Bk2, Y2, M2, C2 | 110 | A | 1.41/1.41 | 0.001/0.001 |
| Ex. 3 | Bk3, Y3, M3, C3 | 120 | B | 1.41/1.41 | 0.001/0.001 |
| Ex. 4 | Bk4, Y4, M4, C4 | 110 | A | 1.41/1.41 | 0.001/0.001 |
| Ex. 5 | Bk5, Y5, M5, C5 | 110 | A | 1.41/1.41 | 0.001/0.001 |
| Ex. 6 | Bk6, Y6, M6, C6 | 110 | A | 1.41/1.41 | 0.001/0.001 |
| Ex. 7 | Bk7, Y7, M7, C7 | 110 | A | 1.41/1.41 | 0.001/0.001 |
| Ex. 8 | Bk8, Y8, M8, C8 | 110 | A | 1.41/1.40 | 0.001/0.001 |
| Ex. 9 | Bk9, Y9, M9, C9 | 110 | A | 1.41/1.41 | 0.001/0.001 |
| Comp. 1 | Bk10, Y10, M10, C10 | 140 | C | 1.40/1.30 | 0.006/0.007 |
| Comp. 2 | Bk11, Y11, M11, C11 | 160 | B | 1.40/1.31 | 0.003/0.003 |
| Comp. 3 | Bk12, Y12, M12, C12 | 130 | C | 1.40/1.32 | 0.005/0.006 |
| Comp. 4 | Bk13, Y13, M13, C13 | 130 | C | 1.40/1.32 | 0.004/0.005 |
| Comp. 5 | Bk14, Y14, M14, C14 | 150 | C | 1.38/1.21 | 0.007/0.010 |

Ex.: Example,
Comp.: Comparative example

As is apparent from Table 2, any of Examples Bk1-Bk9, Examples C1-C9, Examples M1-M9 and Examples Y1-Y9 exhibited excellent results in any evaluation items, while Comparative examples Bk1-Bk5, Comparative examples C1-C5, Comparative examples M1-M5 and Comparative examples Y1-Y5 showed problems in some of the evaluation items.

What is claimed is:

1. An electrostatic image developing toner comprising a binder resin and a colorant, wherein the toner comprises a compound represented by the following Formula (1):

Formula (1)

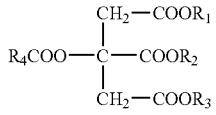

wherein, $R_1$, $R_2$, $R_3$ and $R_4$ each independently represent an alkyl group having 10 to 30 carbon atoms and the alkyl group may have a substituent.

2. The toner of claim 1, wherein the weight content of the compound represented by the Formula (1) is 1 to 15% by weight of the toner.

3. The toner of claim 1, wherein the weight content of the compound represented by the Formula (1) is 3 to 12% by weight of the toner.

4. The toner of claim 1, having a volume median diameter ($Dv_{50}$) in the range of 3 to 9 μm.

5. The toner of claim 1, wherein a CV value in volume particle size distribution of the toner is not more than 20%.

6. The toner of claim 1, wherein the compound comprises at least one of the following compounds (1) to (7):

(1)

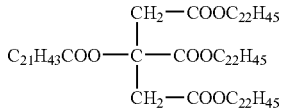

(2)

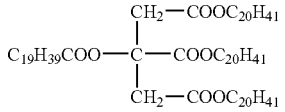

(3)

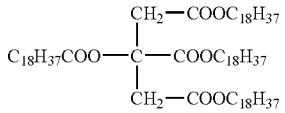

(4)

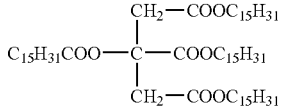

(5)

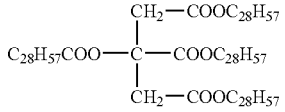

(6)

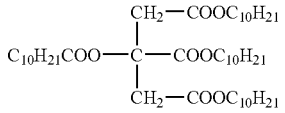

(7)

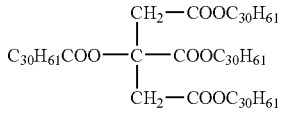

7. The toner of claim 6, wherein the weight content of the compound represented by Formula (1) is 3 to 12% by weight and the toner has a volume median diameter ($Dv_{50}$) in the range of 3 to 9 μm.

8. The toner of claim 1, wherein the compound represented by Formula (1) exists in the toner particle with forming domains.

9. An image forming method comprising:

developing a latent image with a toner as defined in claim 1 so as to form a toner image.

10. The image forming method of claim 9, further comprising fixing the toner image on an image forming material by passing between a first rotating member and a second rotating member, wherein at least one of the first and second rotating members gives heat to the toner image.

11. The image forming method of claim 10, wherein the first rotating member is a roller and is provided with a heat source inside of the roller.

12. The image forming method of claim 11, wherein the second rotating member includes a roller or a endless belt.

* * * * *